US007408511B2

(12) United States Patent
Liu

(10) Patent No.: US 7,408,511 B2
(45) Date of Patent: Aug. 5, 2008

(54) MIMO ANTENNA CONFIGURATION

(75) Inventor: I-Ru Liu, Taipei (TW)

(73) Assignee: Accton Technology Corporation, Hsinchu (TW)

( * ) Notice: Subject to any disclaimer, the term of this patent is extended or adjusted under 35 U.S.C. 154(b) by 247 days.

(21) Appl. No.: 11/342,708

(22) Filed: Jan. 31, 2006

(65) Prior Publication Data

US 2007/0176829 A1 Aug. 2, 2007

(51) Int. Cl.
*H01Q 1/38* (2006.01)
*H01Q 1/42* (2006.01)
*H01Q 9/16* (2006.01)

(52) U.S. Cl. ..... 343/700 MS; 343/872; 343/793

(58) Field of Classification Search ..... 343/700 MS, 343/793, 872, 893
See application file for complete search history.

(56) References Cited

U.S. PATENT DOCUMENTS 6,426,723 B1 * 7/2002 Smith et al. ..... 343/700 MS
7,119,744 B2 * 10/2006 Theobold et al. ..... 343/700 MS
2003/0134596 A1 * 7/2003 Zhu ..... 455/41

* cited by examiner

*Primary Examiner*—Shih-Chao Chen
(74) *Attorney, Agent, or Firm*—Birch, Stewart, Kolasch & Birch, LLP

(57) ABSTRACT

The present invention provides a MIMO antenna structure and design. A single dipole antenna stands at the center of a triangle which is formed by three PIFAs antennas, and the three PIFA antennas has equal squint angle relative to the neighbors, that is there is 120° sector angle between any two PIFA axes of three such that the dipole and the other PIFAs forms a tetrahedron. The MIMO antenna structure of the present invention is simpler in mechanics but high efficiency in performance.

22 Claims, 7 Drawing Sheets

Convex Cubical antenna Structure
($0° \leq \phi \leq 360°$, $0° \leq \theta \leq 90°$ symmetrically)

Co-linear Antenna Structure
($0° \leq \phi \leq 180°$, $\theta = 90°$ symmetrically)

Co-linear Antenna Structure
($0° \leq \phi \leq 180°$, $\theta = 90°$ symmetrically)

Vertically Coplanar Antenna Structure
($0° \leq \phi \leq 180°$, $0° \leq \theta \leq 90°$ symmetrically)

Vertically Coplanar Antenna Structure
($0° \leq \phi \leq 180°$, $0° \leq \theta \leq 90°$ symmetrically)

Vertically Coplanar Antenna Structure
($0° \leq \phi \leq 90°$, $0° \leq \theta \leq 90°$ symmetrically)

Vertically Coplanar Antenna Structure
($0° \leq \phi \leq 90°$, $0° \leq \theta \leq 90°$ symmetrically)

Vertically Coplanar antenna Structure
($0° \leq \phi \leq 360°$, $\theta = 90°$ symmetrically)

Horizontally Coplanar Antenna Structure
($0° \leq \phi \leq 360°$, $\theta = 90°$ symmetrically)

Slant Cubical Antenna Structure
($0° \leq \phi \leq 90°$, $0° \leq \theta \leq 90°$ symmetrically)

Askew Cubical Antenna Structure
($0° \leq \phi \leq 360°$, $0° \leq \theta \leq 90°$ symmetrically)

Concave Cubical antenna Structure
($0° \leq \phi \leq 360°$, $0° \leq \theta \leq 90°$ symmetrically)

Convex Cubical antenna Structure
($0° \leq \phi \leq 360°$, $0° \leq \theta \leq 90°$ symmetrically)

Solid Cubical Antenna Structure
($0° \leq \phi \leq 360°$, $0° \leq \theta \leq 90°$ symmetrically)

MIMO ANTENNA CONFIGURATION

BACKGROUND OF THE INVENTION

1. Field of the Invention

This invention relates to a structure for antenna, and more especially, to the antenna configuration for the access point (AP) adapted to the wireless local-area network (WLAN) or wireless metropolitan area network (WMAN).

2. Description of the Prior Art

Wireless communication systems have been developed rapidly. No matter in the business or in the family, the wireless communication systems are everywhere in people's life and are widely employed to provide various types of communication such as voice, data, and so on.

A multiple-input multiple-output (MIMO) communication system employs multiple transmit antennas and multiple receive antennas for transmission and reception of spatial-multiplexing data streams. In a point-to-point system, the data streams are transmitted to or received from a single terminal. However, a multiple access communication system having a base station may also concurrently communicate with a number of terminals. In this case, the base station employs multiple antennas to transmit or receive spatially multiplexed data streams to or from each terminal; each terminal on the other hand, employs multiple antennas to receive or transmit spatially multiplexed data streams from or to base station.

The advantage of the MIMO wireless systems is that the capability of the wireless link between the transmitter and receiver is improved compare with previous systems in the respect that higher data rates can be obtained. That is, higher spectral efficiencies are achieved than with non-MIMO systems.

Considering diversity gain, which is defined by:

$$(\text{Ideal Diversity Gain})\times(1-\rho)^{(1/2)},$$

where the Ideal Diversity Gain is proportional to the dimensions n×m, n or m, wherein m for Transmit diversity gain, n for receive diversity gain, n×m for total system diversity gain. The correlation coefficient p which should be much less than unity is a function of: (1) separated antenna patterns (angular separation); (2) separated antenna positions (spatial separation); (3) isotropic distribution of incoming multipath waves (angular spread); (4) evenly-dispersive distribution of incoming multipath waves (delay spread).

Spatial Multiplexing technology is used for enhancing the transmission rate of the MIMO system. The spatial multiplexing gain that relates to throughput enhancement depends on orthogonality condition of MIMO antennas. In line of sight (LOS) or non-scattering MIMO environment or outdoor area, orthogonality condition is:

$$St\times Sr/R\geqq\lambda/M,$$

where St and Sr are transmit and receive antenna spacings respectively, R is the range from transmit antennas to receive antennas, M is the number of receive antennas, the transmit antenna number N is not used in this condition.

As examples of access point (AP) and laptop PC, let F=5 GHz or λ=0.06 m, R=100 m, then St≧12.5 m or 208 λ, if $M$=2 and Sr=0.24 m;

St≧25 m or 417 λ, if M=4 and Sr=0.06 m.

In general, we can set 100 λ<St as a design rule in outdoor MIMO environment.

In none line of sight (NLOS) or scattering MIMO environment or indoor area, orthogonality condition is:

$$[2\times Dt/(N-1)]\times[2\times Dr/(M-1)]\geqq R\times\lambda/M,$$

where Dt and Dr are transmit and receive scattering radii respectively, R is the range from transmit scattering center to receive scattering center, N and M are the numbers of transmit and receive antennas respectively.

The scattering is made by scatterers in MIMO environment, which can be modeled by omni-directional ideal reflectors. The scatterers are assumed to be located sufficiently far from antennas for holding plane-wave assumption and further assumed such that Dt (or Dr) is much less than R for meeting local scattering condition.

As examples of AP and laptop PC, let F=5 GHz or λ=0.06 m, R=100 m, Dr=Dt, then

Dt=Dr≧0.866 m or 14.4 λ, if N=M=2;

Dt=Dr≧1.061 m or 17.7 λ, if N=2≠M=4;

Dt=Dr≧1.500 m or 25.0 λ, if N=4≠M=2;

Dt=Dr≧1.837 m or 30.6 λ, if N=M=4.

In general, St<Dt. We can set 1 λ≦St≦10λ as a design rule in indoor MIMO environment.

According to the design rule, considering a device with a rectangular housing and 4 antennas, which can be used in 4×4 MIMO antenna system as base station or AP, there are several types of structure already known. FIG. 1 shows a co-linear antenna structure. There are four dipole antennas 2 connect to the AP housing 1, and the four dipole antennas 2 are align to the long side of the housing 1. FIG. 2 shows another co-linear antenna structure with the four dipole antennas 2 replaced by four Planar Inverted F Antennas 3(PIFAs). FIG. 3 shows a vertically coplanar antenna structure, where there are two dipole antennas 2 stands vertically by the two sides and two PIFAs 3 located within the housing 1. Alternatively, FIG. 4 shows another type of vertically coplanar antenna structure including two PIFAs 3 that are positioned inside the housing 1 at two corners of housing 1 and two dipole antennas 2 that stands vertically between the PIFAs 3 with equally spacing between the PIFA 3 and dipole antenna 2.

Please refer to FIG. 5, it shows alternative vertically coplanar antenna structure with two dipole antennas 2 and two PIFAs 3 aligned interlocked along the long side of housing 1. FIG. 6 illustrates another vertically coplanar antenna structure, where the two dipole antennas 2 and two PIFAs 3 positioned separately by the long side of the housing 1. Referring to FIG. 7, it shows a vertically coplanar antenna structure, where there are four dipole antennas 2 stands vertically by the four corners of the housing 1. Similarly, FIG. 8 shows another horizontally coplanar antenna structure, where there are four PIFAs 3 positioned at four corners of the housing 1. Alternatively, FIG. 9 shows a slant cubical antenna structure, where the two dipole antennas 2 stand vertically at two corners of one long side and the two PIFAs 3 stands at the other corners by the other long side of the housing 1. FIG. 10 shows askew cubical antenna structure, in the configuration, two dipole antennas 2 and two PIFAs 3 stands interlaced at four corners of the housing 1. FIG. 11 shows a concave cubical antenna structure, where there are three dipole antennas 2 stands vertically and forms a triangle at top surface of the housing 1, and the PIFA 3 positioned ant the center of the triangle inside of the housing 1.

The disadvantage of the antenna structures of the 4×4 MIMO system shown from FIG. 1 to FIG. 11 is that the efficiency of the system is poor. Furthermore, the system is more complex in mechanics and the cost is higher. What is required is a novel structure of MIMO antenna system to optimums the mechanics and cost.

Further benefits and advantages of the invention will become apparent from a consideration of the following detailed description of the following detailed description given with reference to the following detailed description given with reference to the accompanying drawings, which specify and show preferred embodiments of the invention.

SUMMARY OF THE INVENTION

The present invention provides a structure for antenna and more especially for a cubical 4×4 MIMO multiple antennas applicable to high throughput wireless networking in WLAN and WMAM. The advantage of the present invention is only one dipole antenna gives low cost benefit to AP. Besides; simple structure gives easiness in mechanical/industrial designs for AP.

Another advantage of the present invention is equal and sufficient far spacing between any pairs of cubical 4×4 MIMO multiple Antennas provides equal and best non-correlation and orthogonality between them. Because, the structure of the present invention gives isotropic (or equal spread in solid angle) distribution of incoming multipath waves, and also gives evenly-dispersive (or equal spread in time delay) distribution of incoming multipath waves.

Besides, the structure of the present invention provides high hemispherical coverage; Good MIMO performance in ceiling or desktop mounts, which give AP equal spatial-multiplexing and antenna-diversity in elevation in addition to azimuth.

And the present invention also provides symmetrically in three 120° sectors; deployment fitted in cellular form which is effective to AP frequency reuse.

The main purpose of the present invention is to provide A structure for MIMO multiple antennas system, comprises: a housing for containing electronics communication modules; a dipole antenna connected to the housing and stands vertically; and three PIFAs connected to a PCB of the electronics communication modules within the housing, wherein the distances between the dipole antenna and each one of three PIFAs are equal.

The housing is a box shaped with a rectangular cross section. The dipole antenna stands outside of said housing. The shape of said housing includes a tetrahedron, a dome, a pyramid or a cube. The dipole antenna stands inside of said housing. The three PIFAs are located on a loop that approximately forms a triangle. The triangle is regular triangle. The distances between said dipole antenna and each one of said PIFAs are greater than 1λ and less than 10λ in typical indoor MIMO area for AP. The distances between said dipole antenna and each one of said PIFAs are greater than 100λ in typical outdoor MIMO area for AP. The three PIFAs are attached on a co-planar surface within said housing.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENT

Method and structure for manufacturing a MIMO antenna is described below. In the following description, numerous specific details are set forth in order to provide a thorough understanding of the present invention, and the scope of the present invention is expressly not limited expect as specified in the accompanying claims.

According to the design rule for MIMO antenna, the spacing between transmit and receive antenna must be wide enough for enhancing the transmission rate of the MIMO system. Besides, the system must satisfied orthogonality condition of MIMO antennas. The transmission antenna spacing St must larger than 100λ in the outdoor environment. The transmission antenna spacing St must larger than 1 λ, and smaller than 10λ at indoor environment.

Figure 1:
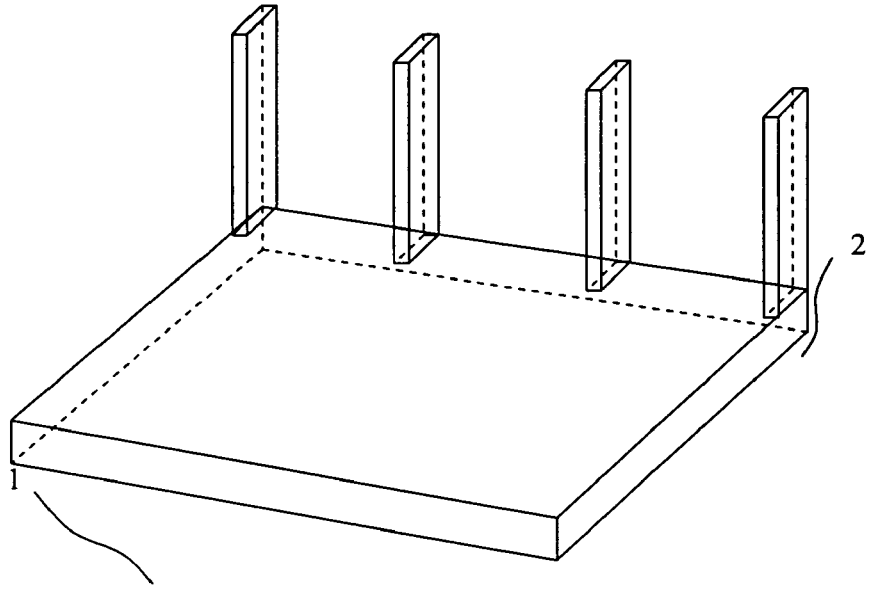
FIG. 1 (PRIOR ART)
FIG. 1 is a diagram of co-linear antenna structure according to the prior art.
Figure 2:
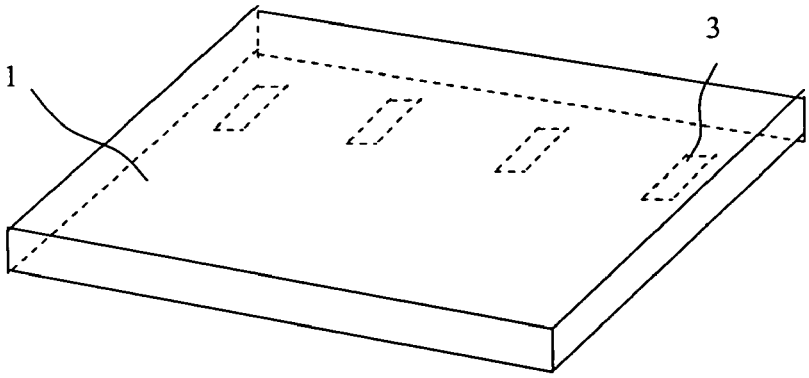
FIG. 2(PRIOR ART)
FIG. 2 is a diagram of co-linear antenna structure according to the prior art.
Figure 3:
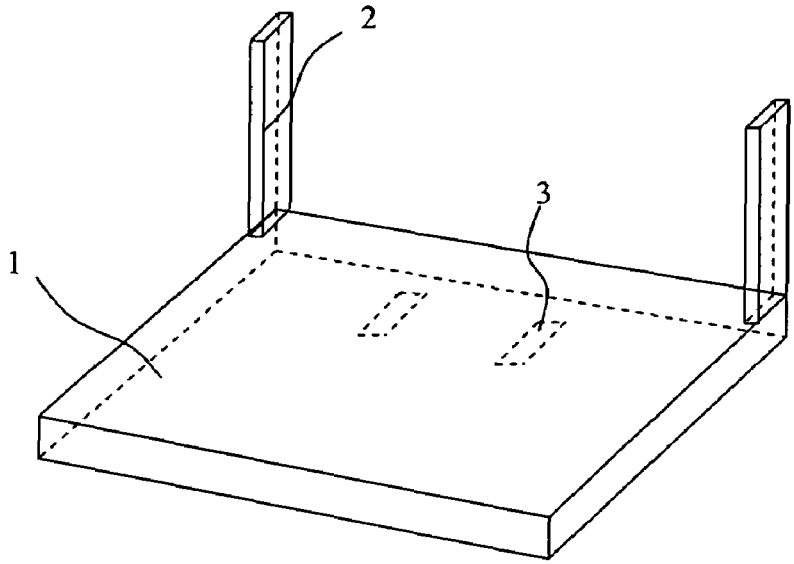
FIG. 3(PRIOR ART)
FIG. 3 is a diagram vertically coplanar antenna structure according to the prior art.
Figure 4:
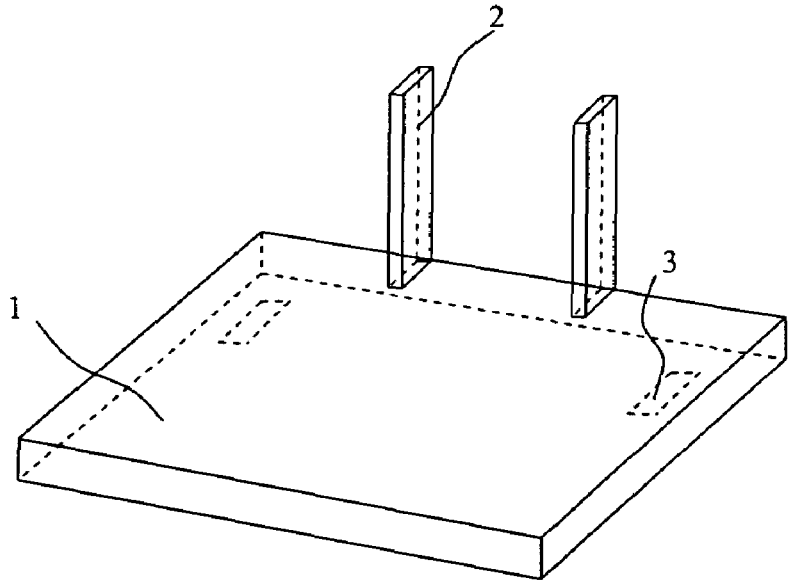
FIG. 4(PRIOR ART)
FIG. 4 is a diagram vertically coplanar antenna structure according to the prior art.
Figure 5:
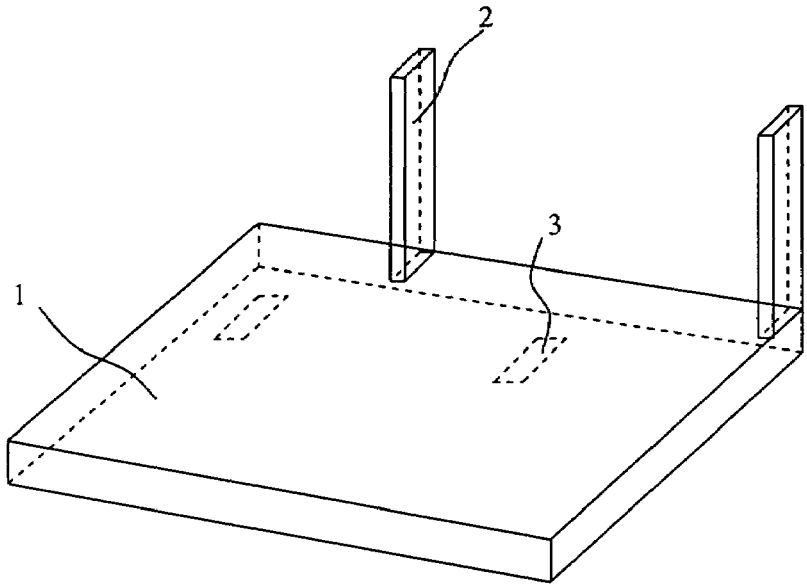
FIG. 5(PRIOR ART)
FIG. 5 is a diagram of vertically coplanar antenna structure according to the prior art.
Figure 6:
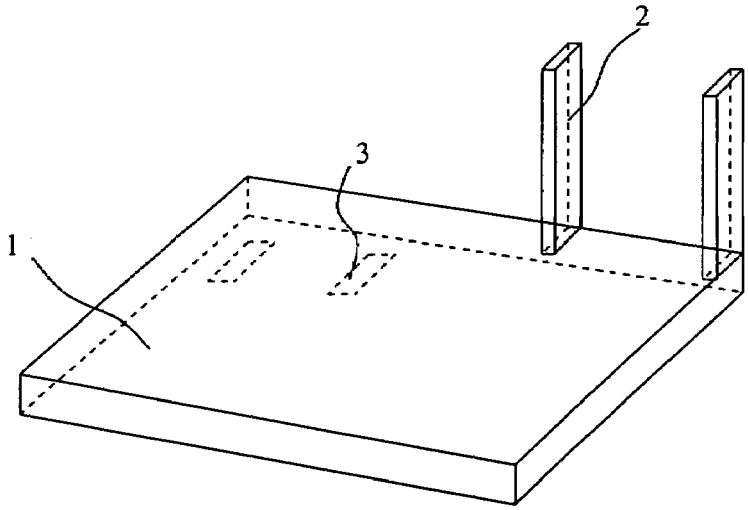
FIG. 6(PRIOR ART)
FIG. 6 is a diagram of vertically coplanar antenna structure according to the prior art.
Figure 7:
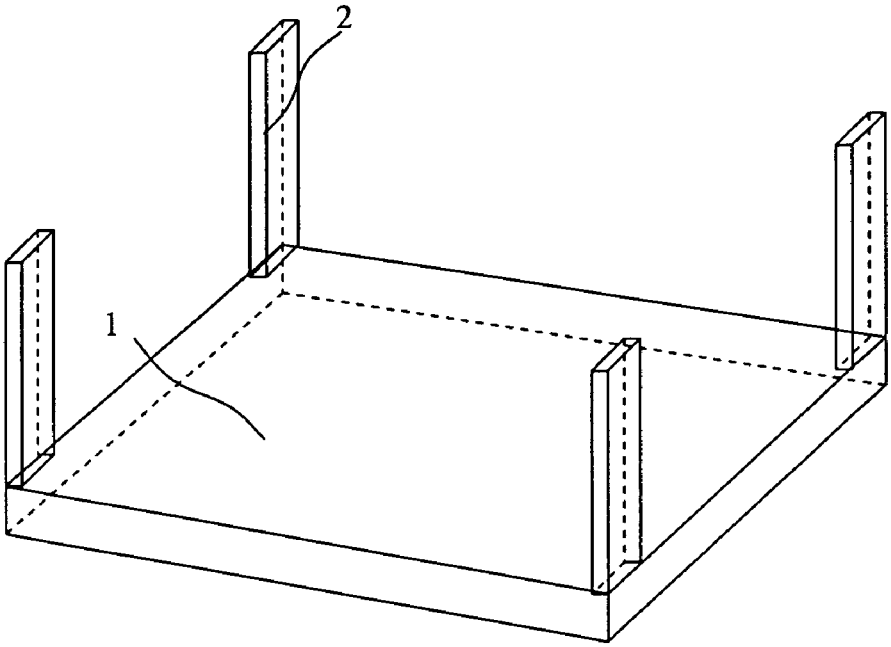
FIG. 7(PRIOR ART)
FIG. 7 is a diagram of horizontally coplanar antenna structure according to the prior art.
Figure 8:
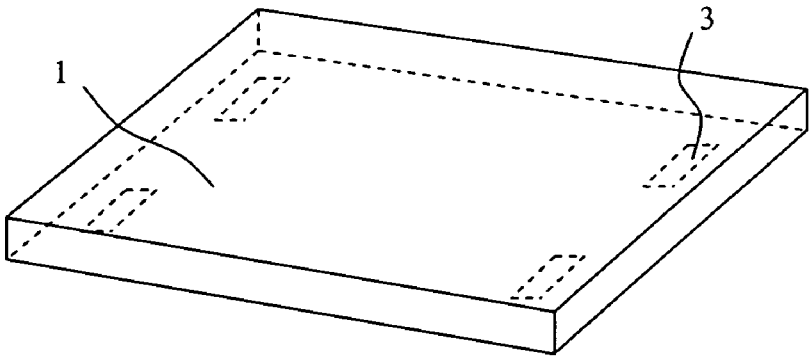
FIG. 8(PRIOR ART)
FIG. 8 is a diagram of horizontally coplanar antenna structure according to the prior art.
Figure 9:
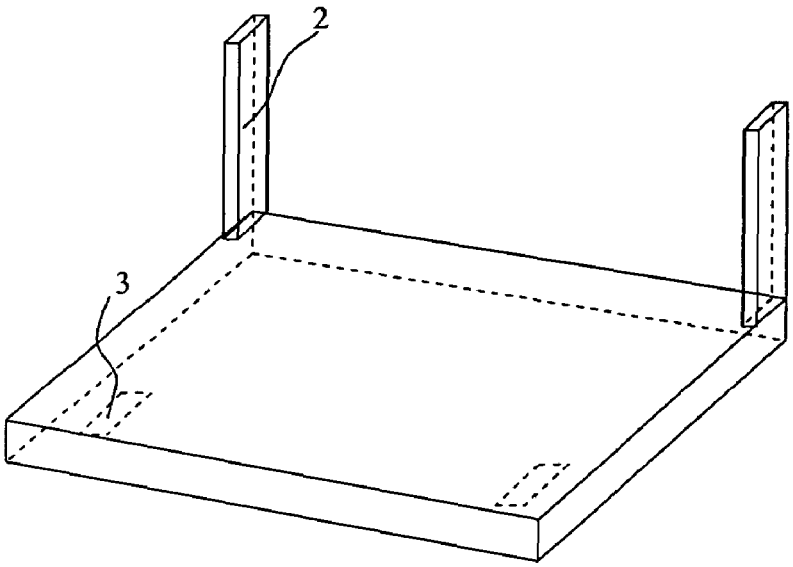
FIG. 9(PRIOR ART)
FIG. 9 is a diagram of slant cubical antenna structure according to the prior art.
Figure 10:
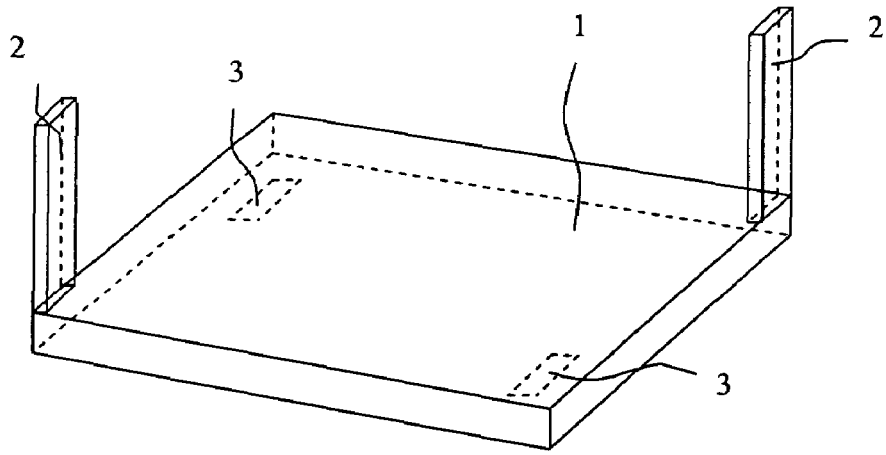
FIG. 10(PRIOR ART)
FIG. 10 is a diagram of askew cubical antenna structure according to the prior art.
Figure 11:
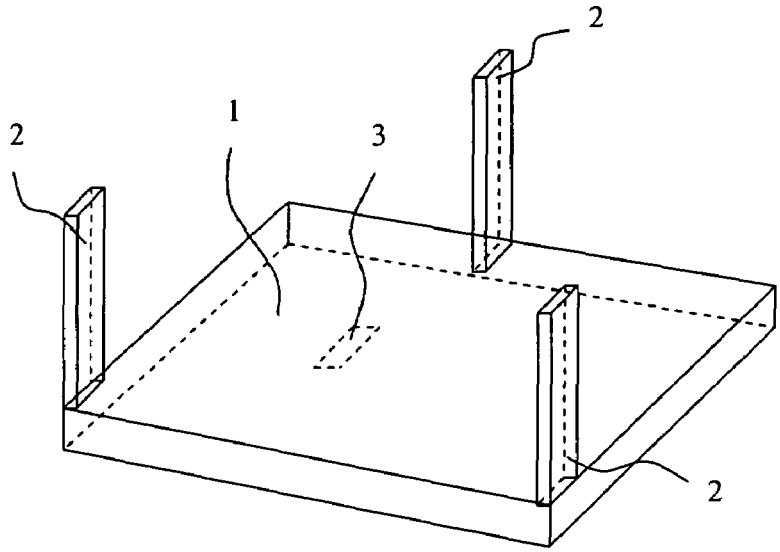
FIG. 11(PRIOR ART)
FIG. 11 is a diagram of concave cubical antenna structure according to the prior art.
Figure 12:
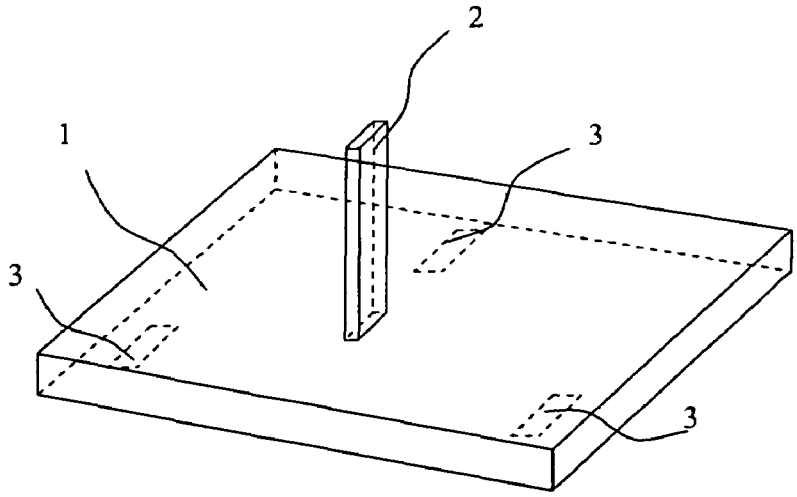
FIG. 12 is a diagram of convex cubical antenna structure according to the present invention.

Referring to FIG. 12, it shows a convex cubical antenna structure for MIMO multiple antennas according to the preferred embodiment of the present invention. A dipole antenna 2 stands vertically on the surface of the housing 1, and three PIFAs 3 connect to PCB inside of the housing 1. The housing 1 is used for containing electronics communication modules. The three PIFAs forms a regular triangle, it means that the three PIFAs are located on a loop that forms triangle, wherein the dipole antenna 2 stands in the center of the triangle. In the embodiment, the hosing 1 of the wireless application device, i.e. AP, is a three-dimension box shaped with a rectangular cross section.

Preferably, the three PIFAs are attached on a surface of a co-planar surface within the housing 1 and on a close loop of a regular triangle. The FIFAs are located approximately at the angle position of the regular triangle. Preferably, the co-plane surface is parallel to the largest surface of the housing 1, namely, the upper or the lower surface of the box. The PIFAs 3 are embedded on a PC Board of the electronics communication modules and generally parallel with each other. Additionally, the distances between each pair of the three embedded PIFA 3 centers are equal.

The dipole antenna 2 stands vertically on the top surface of the housing 1. The distances from the center of the dipole antenna 2 to each of the three PIFAs 3 are equal. The distances are all greater than 1λ and less than 10λ in typical indoor MIMO area for AP, and it is greater than 100λ in typical outdoor MIMO area for AP.

The orientation of three PIFAs 3 can be optionally radial from the center of PC Board. No much pattern/polarization diversity is gained by this orientation. In the case, the radiation angle between each PIFA is about 120 degree, that is, there is 120° sector angle between any two PIFA axes of three.

Figure 14:
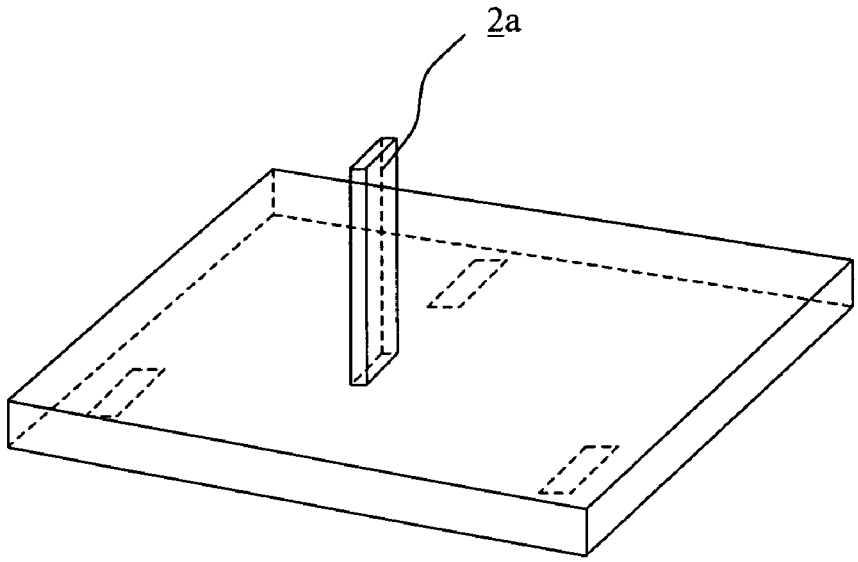
FIG. 14 is a diagram of convex cubical antenna structure according to the present invention.

Especially, the dipole 2 can be replaced by a standalone antenna module, i.e. by standalone PIFA module or by other standalone vertical-polarization antenna module with adequate mounting mechanism as shown in FIG. 14. In one case, the antenna module includes a pillar structure 2*a* having a antenna located at the upper portion of the pillar structure 2*a*.

The system of the present invention can be AP with MIMO antenna which is placed in ceiling or desktop mounts to provide high hemispherical. The present invention provides good MIMO performance, and equal spatial-multiplexing and antenna-diversity in elevation in addition to azimuth.

Figure 13:
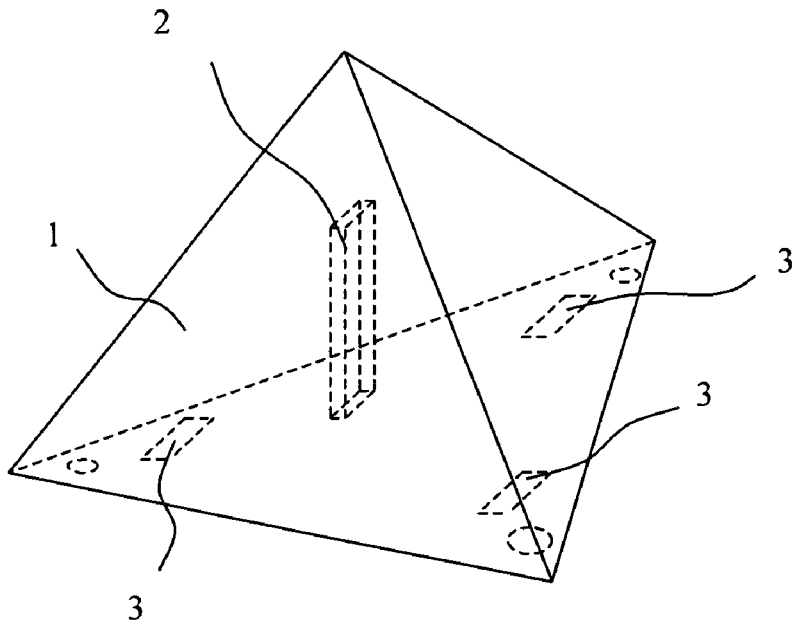
FIG. 13 is a diagram of solid cubical antenna structure according to the present invention.

Referring to FIG. 13, which is another preferred embodiment of the present invention. The housing 1 is shaped with a tetrahedron, a dome, a pyramid or a cube shape. And a dipole antenna 2 stands vertically inside the housing 1, and resided at the center of the housing 1. The device includes three PIFAs 3 embedded in a PC board at the corners of the housing 1, or symmetrically by rim. The geometry configuration of the dipole antenna 2 and the PIFAs 3 are similar to the embodiment of FIG. 12 except the shape of the housing 1. Therefore, the similar description is omitted. It should be noted that the dipole antenna can be replaced by the pillar structure having PIFA as illustrated in FIG. 14. The symmetrically of the present invention is approximately $0° \leqq \phi \leqq 360°$, $0° \leqq \theta \leqq 90°$, where $\phi$ is the angle of the x-y (horizontal) plane, and $\theta$ is the one of x-z (vertical) plane.

In conclusion, we have proposed that the dipole can be replaced by a standalone antenna module, i.e. by a standalone fourth PIFA module or by other standalone vertical-polarization antenna module, with adequate mounting mechanism. The present invention provides Good MIMO performance in ceiling or desktop mounts, which give AP equal spatial-multiplexing and antenna-diversity in elevation in addition to azimuth.

Although specific embodiments have been illustrated and described, it will be obvious to those skilled in the art that various modifications may be made without departing from what is intended to be limited solely by the appended claims.

What is claimed is:

1. A structure for MIMO multiple antennas system, comprises:

a housing for containing electronics communication modules;

a dipole antenna connected to said housing and stands vertically; and three PIFAs connected to a PCB of said electronics communication modules within said housing, wherein the distances between said dipole antenna and each one of said three PIFAs are equal.

2. The structure in claim 1, wherein said housing is a box shaped with a rectangular cross section.

3. The structure in claim 2, wherein said dipole antenna stands outside of said housing.

4. The structure in claim 1, wherein the shape of said housing including a tetrahedron, a dome, a pyramid or a cube.

5. The structure in claim 4, wherein said dipole antenna stands inside of said housing.

6. The structure in claim 1, wherein said three PIFAs are located on a loop that approximately forms a triangle.

7. The structure in claim 6, wherein said triangle is regular triangle.

8. The structure in claim 1, wherein said distances between said dipole antenna and each one of said PIFAs are greater than 1λ and less than 10λ in typical indoor MIMO area for an access point.

9. The structure in claim 1, wherein said distances between said dipole antenna and each one of said PIFAs are greater than 100λ in typical outdoor MIMO area for an access point.

10. The structure in claim 1, wherein said three PIFAs are attached on a co-planar surface within said housing.

11. A structure for MIMO multiple antennas system, comprises:

a housing for containing electronics communication modules;

a standalone antenna module connected to said electronics communication modules and stands vertically on said housing; and three PIFAs connected to a PCB of said electronics communication modules within said housing, wherein the distances between said standalone antenna module and each one of said three PIFAs are equal.

12. The structure in claim 11, wherein said standalone antenna module including a standalone PIFA module.

13. The structure in claim 12, wherein said standalone antenna module stands outside of said housing.

14. The structure in claim 11, wherein said standalone antenna module including a standalone vertical-polarization module.

15. The structure in claim 11, wherein said hosing is a box shaped with a rectangular cross section.

16. The structure in claim 15, wherein said standalone antenna module stands inside of said housing.

17. The structure in claim 11, wherein the shape of said housing including a tetrahedron, a dome, a pyramid or a cube.

18. The structure in claim 17, wherein said three PIFAs form regular triangle.

19. The structure in claim 11, wherein said three PIFAs are located on a loop that approximately forms a triangle and mounted on the corners of said housing.

20. The structure in claim 11, wherein said distances between said standalone antenna module and each one of said three PIFAs are greater than 1λ and less than 10λ in typical indoor MIMO area for an access point.

21. The structure in claim 11, wherein said distances between said standalone antenna module and each one of said three PIFAs are greater than 100λ in typical outdoor MIMO area for an access point.

22. The structure in claim 11, wherein said three PIFAs are attached on a co-planar surface within said housing.

* * * * *